US008910834B2

(12) United States Patent
Becker et al.

(10) Patent No.: US 8,910,834 B2
(45) Date of Patent: Dec. 16, 2014

(54) FLEXIBLE CONTAINER HAVING A GRIP

(75) Inventors: Rudiger Becker, San Francisco, CA (US); Francis J. Handy, Kentfield, CA (US)

(73) Assignee: Method Products, PBC, San Francisco, CA (US)

( * ) Notice: Subject to any disclaimer, the term of this patent is extended or adjusted under 35 U.S.C. 154(b) by 402 days.

(21) Appl. No.: 12/954,202

(22) Filed: Nov. 24, 2010

(65) Prior Publication Data

US 2012/0125947 A1 May 24, 2012

(51) Int. Cl.

| | |
|---|---|
| ***A47G 19/14*** | (2006.01) |
| ***B65D 35/22*** | (2006.01) |
| ***B65D 75/56*** | (2006.01) |
| ***B65D 75/58*** | (2006.01) |

(52) U.S. Cl.

CPC ..... *B65D 75/56* (2013.01); *B65D 75/563* (2013.01); *B65D 75/566* (2013.01); *B65D 75/5816* (2013.01); *B65D 75/5883* (2013.01)

USPC ..... 222/465.1; 222/94; 222/105; 383/9; 383/104

(58) Field of Classification Search

USPC ..... 222/1, 105, 107, 94, 130, 465.4, 465.1; 383/104, 9, 906, 25, 26

See application file for complete search history.

(56) References Cited

U.S. PATENT DOCUMENTS

| | | | | |
|---|---|---|---|---|
| 1,521,184 | A | | 12/1924 | Holton |
| 2,789,571 | A | * | 4/1957 | Kurman ..... 135/34.2 |
| 2,832,606 | A | * | 4/1958 | Patterson ..... 280/37 |
| 2,847,227 | A | * | 8/1958 | Lankford ..... 280/42 |
| 3,304,977 | A | * | 2/1967 | Hammons ..... 604/409 |
| 3,318,505 | A | * | 5/1967 | Speas et al. ..... 229/103.1 |
| 4,305,161 | A | | 12/1981 | Diaz |
| 4,377,192 | A | * | 3/1983 | Gautier ..... 383/7 |
| 4,603,433 | A | * | 7/1986 | Gautier et al. ..... 383/7 |
| 4,637,934 | A | | 1/1987 | White |
| 4,680,808 | A | * | 7/1987 | Paleschuck ..... 383/9 |
| 4,978,025 | A | | 12/1990 | Fougeres |
| 5,184,760 | A | * | 2/1993 | Weinstein et al. ..... 222/207 |
| 5,400,494 | A | * | 3/1995 | Stilley ..... 29/434 |

(Continued)

FOREIGN PATENT DOCUMENTS

| | | |
|---|---|---|
| DE | 40 37 456 A1 | 5/1992 |
| EP | 1 967 464 A1 | 9/2008 |

(Continued)

OTHER PUBLICATIONS

International Search Report and Written Opinion for International Appl. No. PCT/US2011/061805, European Patent Office, The Netherlands, mailed on Jan. 3, 2012, 10 pages.

*Primary Examiner* — Patrick M Buechner

(74) *Attorney, Agent, or Firm* — Sterne, Kessler, Goldstein & Fox P.L.L.C.

(57) ABSTRACT

A flexible container for containing a product includes a dispensing portion, a panel forming a first compartment for containing the product and forming a second compartment that is separate from the first compartment, and an elongated grip disposed at least in part in the second compartment. A user may grasp the grip to transport the container or to pour a product from the first compartment. The grip may also prevent the container from collapsing, allowing the container to be efficiently stored on a surface and providing a surface on the flexible container to prominently display information regarding the product. The dispensing portion may be a metered cap.

16 Claims, 6 Drawing Sheets

(56) References Cited

U.S. PATENT DOCUMENTS

| | | | | |
|---|---|---|---|---|
| 5,927,569 | A * | 7/1999 | Gottlieb | 222/529 |
| 6,267,393 | B1 * | 7/2001 | Mengrone et al. | 280/37 |
| 6,872,197 | B1 | 3/2005 | Witowski | |
| 6,921,201 | B2 | 7/2005 | Richardson, Jr. et al. | |
| 6,923,574 | B2 | 8/2005 | Siegel | |
| 7,159,742 | B2 | 1/2007 | Lee | |
| 7,819,582 | B2 * | 10/2010 | Rosen | 383/7 |
| 2001/0040732 | A1 * | 11/2001 | Perlsweig | 359/553 |
| 2004/0094919 | A1 * | 5/2004 | Roder et al. | 280/30 |
| 2004/0096127 | A1 | 5/2004 | Rosen | |
| 2005/0140103 | A1 * | 6/2005 | Marchant et al. | 280/47.26 |
| 2005/0241976 | A1 | 11/2005 | Britto et al. | |
| 2006/0108375 | A1 * | 5/2006 | Pritchard | 222/107 |
| 2006/0257057 | A1 | 11/2006 | Andersen | |
| 2007/0047851 | A1 * | 3/2007 | Sato et al. | 383/104 |
| 2007/0104398 | A1 * | 5/2007 | Ours | 383/211 |
| 2007/0133909 | A1 * | 6/2007 | Arvizu | 383/104 |
| 2007/0177828 | A1 * | 8/2007 | Takada et al. | 383/200 |
| 2008/0107781 | A1 * | 5/2008 | Carroll | 426/128 |
| 2008/0193057 | A1 | 8/2008 | Nomura et al. | |
| 2008/0226205 | A1 | 9/2008 | Sillik | |
| 2008/0247682 | A1 | 10/2008 | Murray | |
| 2009/0123093 | A1 * | 5/2009 | Lemoyne et al. | 383/99 |
| 2010/0243670 | A1 * | 9/2010 | Tysiac | 222/1 |
| 2011/0103719 | A1 * | 5/2011 | Wang | 383/105 |
| 2011/0280501 | A1 * | 11/2011 | Brauer et al. | 383/26 |

FOREIGN PATENT DOCUMENTS

| | | | |
|---|---|---|---|
| JP | 07-219197 | A | 8/1995 |
| WO | WO 00/66448 | | 11/2000 |
| WO | WO 2010/069428 | A1 | 6/2010 |

* cited by examiner

FLEXIBLE CONTAINER HAVING A GRIP

BACKGROUND

1. Field of the Invention

The present invention relates to flexible bags for containing a product and, particularly, flexible bags having a grip to assist a user in handling the bag while transporting or dispensing the product.

2. Background Art

Bags that have flexible walls forming a compartment for containing a product and that have a port for pouring the product from the compartment are known. Such flexible bags often contain substances that can easily change shape, for example, liquids, gels, and granular solids. Flexible bags are popular because they are generally cheaper to manufacture, package, and ship than rigid containers. Flexible bags are also more environmentally friendly than rigid containers because they require less material and energy to produce.

Flexible bags, however, can be hard to handle because they lack structural support. Because the walls can easily change shape, the flexible bag can collapse when a user grabs a conventional flexible bag. Handling becomes even more difficult as the weight of the product within the bag increases and as the product is dispensed from the bag. The bag's collapsibility makes it hard for a user to securely grab the bag during transport or precisely align the bag when dispensing the product from the bag. Flexible bags also have a tendency to collapse when placed on a surface. The bags' collapsibility makes it difficult to efficiently arrange flexible bags on a shelf, for example, at a retail store. Also because flexible bags collapse when placed on a surface, flexible bags do not have a good surface to display information, for example, brand name, product identification, directions for use, and other types of information regarding the product.

Examples of flexible bags include U.S. Patent Application Publication No. 2008/0247682 to Murray, which discloses a stand-up flexible pouch for packaging a product having a flexible panel forming a body of the pouch and a rib formed integrally with the panel to add structural strength. While the integral rib adds structural strength to the pouch, it is not intended to be a handle nor is it ergonomical and easily accessible to a user's hand. Another example of a flexible container is U.S. Patent Application Publication No. 2004/0096127 to Rosén. The '127 publication discloses a container for liquid contents made from flexible walls. The container has a carrying means that forms a handle that allows a user to lift the container. The carrying means, however, is integral with the container and does not prevent the flexible container from collapsing along the container's body. Thus, there is still a need for a flexible bag having a grip that maintains the economical and environmental advantages of a conventional flexible bag, that is ergonomically and easily accessible to a user's hand, and that provides sufficient structural strength to prevent the bag from collapsing when the product is being dispensed. There is also a need for a flexible bag having a structure that prevents the bag from collapsing when placed on a shelf, allowing the bag to be efficiently stored and providing a surface to display information.

BRIEF SUMMARY OF THE INVENTION

In one embodiment, a flexible bag for containing a product comprises a dispensing portion, at least one panel forming a first compartment for containing a product; and an elongated, tubular grip disposed on the at least one panel that is offset from an outer edge of the at least one panel. A user may grasp the grip to transport the bag or dispense the product from the first compartment. The at least one panel may further form a discrete second compartment within which the grip is disposed at least in part. The grip may also be disposed entirely in the second compartment. The second compartment may run along substantially the entire length of the outer edge of the at least one panel, and the grip may have a length that is substantially the entire length of the second compartment. The at least one panel may comprise a flexible film. The dispensing portion may be a pour spout.

In another embodiment, a flexible bag for containing a product comprises a dispensing portion, at least one panel forming a first compartment for containing the product and a second compartment that is separate from the first compartment, and an elongated grip disposed at least in part in the second compartment. A user may grasp the grip to transport the bag or to pour a product from the first compartment. The grip may be disposed entirely in the second compartment. The second compartment may be near an outer edge of the at least one panel. The second compartment may also have a length that is substantially the entire length of the outer edge of the at least one panel, and the grip may have a length that is substantially the entire length of the second compartment. The grip may also be tubular or include a tapered end portion. The at least one panel may comprises a flexible film. The dispensing portion may be a pour spout.

In another embodiment, a flexible bag for containing a product comprises a dispensing portion, at least one panel having a seam forming a first compartment for containing a product and forming a second compartment that is separate from the first compartment, and a grip disposed at least in part in the second compartment. A user may grasp the grip to transport the bag or to pour the product from the first compartment. The second compartment may run along substantially the entire length of an outer edge of the at least one panel. Additionally, the grip may have a length that is substantially the entire length of the second compartment. The at least one panel may include a front panel, a back panel, and a bottom panel, and the seam may comprise a plurality of seams. The grip may also be disposed entirely in the second compartment and include a tapered end portion. The grip may also be tubular. The at least one panel comprises flexible film. The dispensing portion may be a pour spout.

BRIEF DESCRIPTION OF THE DRAWINGS/FIGURES

The accompanying drawings, which are incorporated herein and form a part of the specification, illustrate the present invention by way of example, and not by way of limitation. The drawings together with the description, further serve to explain the principles of the invention and to enable a person skilled in the pertinent art to make and use the invention.

DETAILED DESCRIPTION OF THE INVENTION

Figure 1:
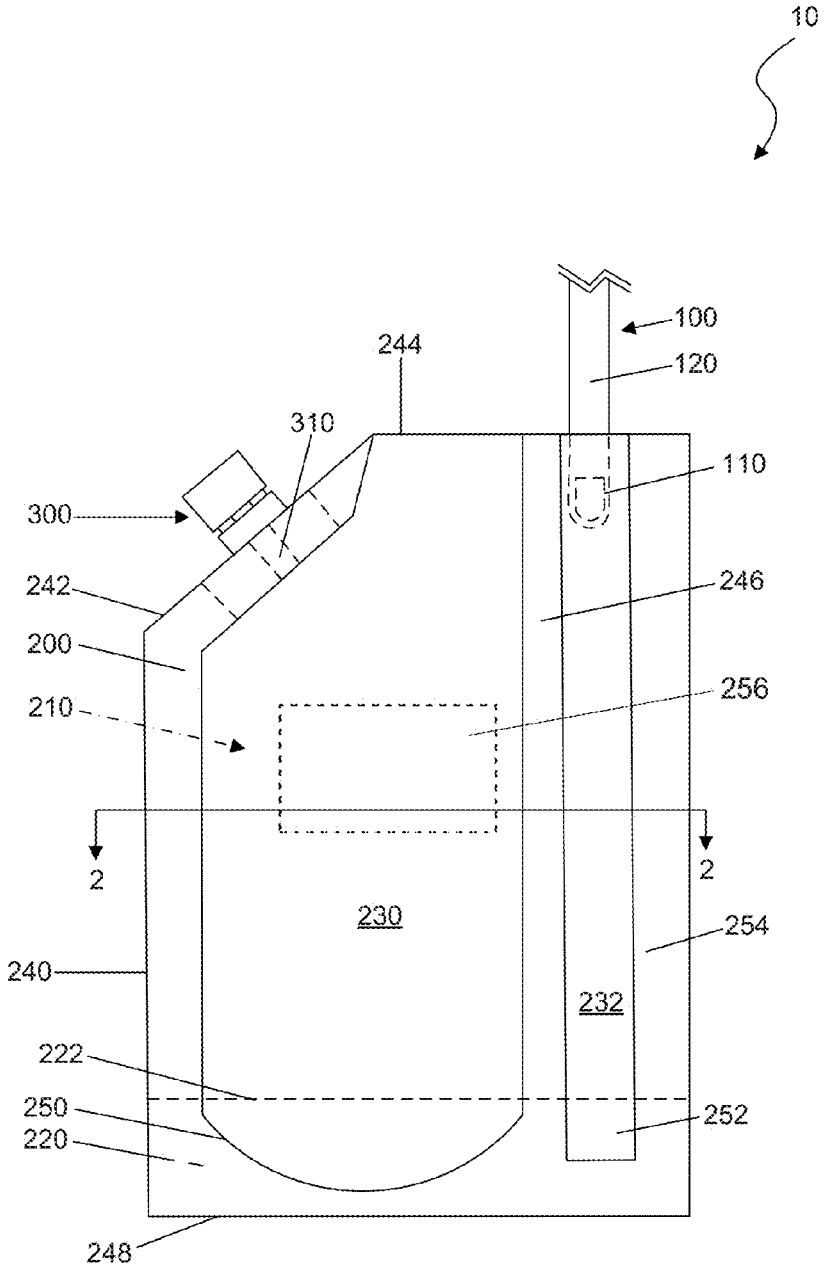
FIG. 1 is a side view of an embodiment of a flexible bag according to the present invention with a grip partially inserted therein.
Figure 2:
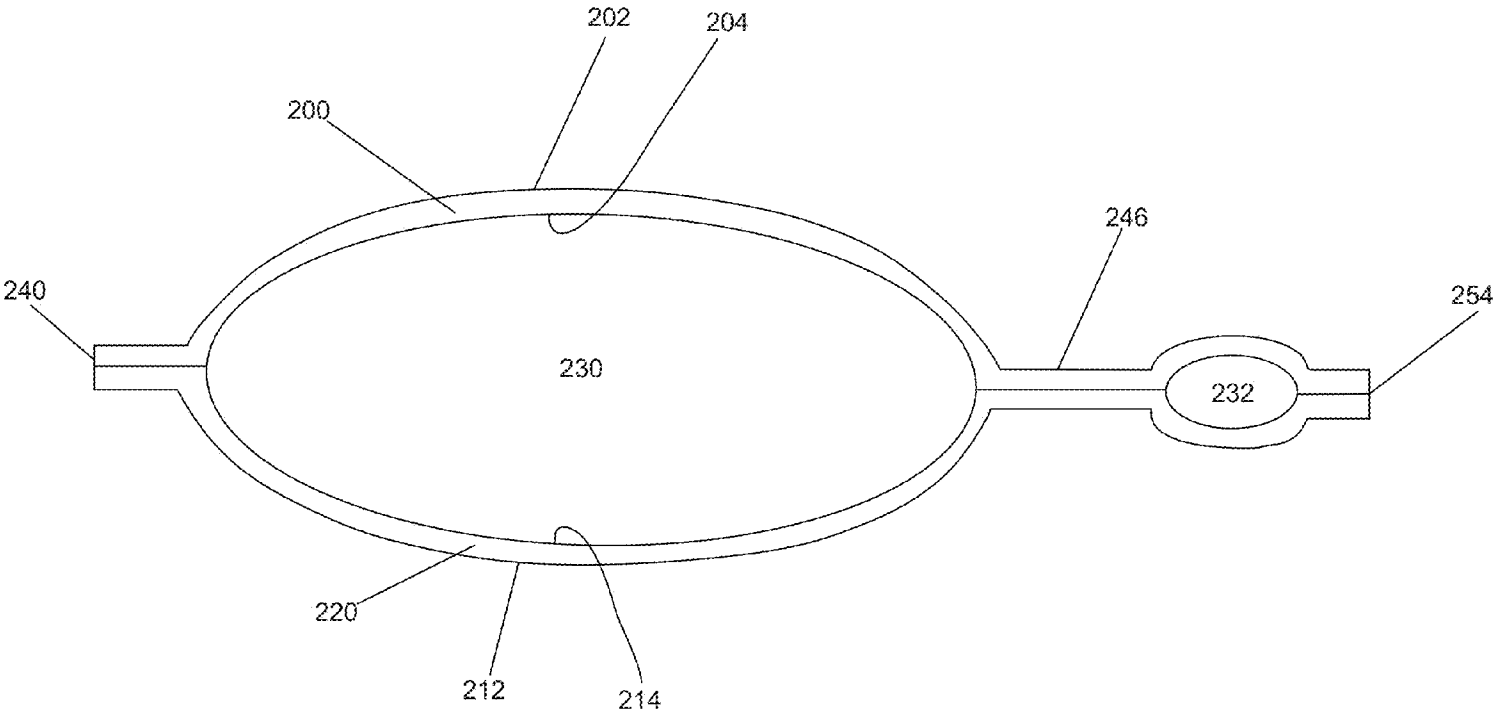
FIG. 2 is a cross-sectional view of the flexible bag of FIG. 1 taken through line 2-2.

The present invention will be described with reference to the accompanying drawings, in which like reference numerals refer to similar elements. While specific configurations and arrangements are discussed, it should be understood that this is done for illustrative purposes only. A person skilled in the pertinent art will recognize that other configurations and arrangements can be used without departing from the spirit and scope of the present invention. It will be apparent to a person skilled in the pertinent art that this invention can also be employed in a variety of other applications.

In one embodiment of the present invention, a flexible bag 10 is made of at least one panel forming a first compartment 230 and a second compartment 232, a grip 100 disposed at least in part in second compartment 232, and a dispensing portion 300. FIGS. 1-7 illustrate the flexible bag shown generally at 10 according to an embodiment of the present invention. In the illustrated embodiment, flexible bag 10 includes grip 100, a front panel 200 having an outer surface 202 and an inner surface 204, a back panel 210 having an outer surface 212 and an inner surface 214, and a bottom panel 220 having an outer surface and an inner surface, and spout 300. Front panel 200, back panel 210, and bottom panel 220 form a first compartment 230 and a second compartment 232. The panels can be a single thin sheet, or film, or a laminate of film made from any suitable flexible material. For example, the panels may be PET, nylon, polyethylene, polypropylene, or a combination thereof. As one example, the panels may be a laminate of PET, nylon, and linear low density polyethylene. In this embodiment, front panel 200 and back panel 210 oppose each other with the inner surface 204 of the front panel 200 being adjacent the inner surface 214 of the back panel 210. Bottom gusset or panel 220 is folded along center line 222 and inserted between front panel 200 and back panel 210 with the inner surface of the bottom panel 220 being adjacent the respective inner surface 204 of the front panel 200 and the inner surface 214 of the back panel 210. First compartment 230 may contain a product (not shown). The product may be any substance that can be placed into first compartment 230. For example, the product may be a liquid, a gel, or a granular solid.

Although in the illustrated embodiment flexible bag 10 is made of three panels—front panel 200, back panel 210, and bottom panel 220—a flexible bag according to the present invention may be made of one panel, two panels, or more than three panels. For example, flexible bag 10 may be formed from a single panel folded along left outer edge 240 and sealed along outer edges of the opposing faces of the panels and along an intermediate portion to define first compartment 230 and second compartment 232. Similarly, flexible bag 10 may be formed from two panels sealed along the outer edges and an intermediate portion to form the compartments 230 and 232.

A flexible bag 10 according to the present invention is not limited to any particular shape. Although in the illustrated embodiment flexible bag 10 is a five-sided polygon, a flexible bag 10 according to the present invention may include other shapes, for example, other polygons or curvilinear shapes. Additionally, the present invention is not limited to a particular size for flexible bag 10. For example, flexible bag 10 according to the present invention may include bags sized to contain as much or as little volume of product as desired.

Figure 8:
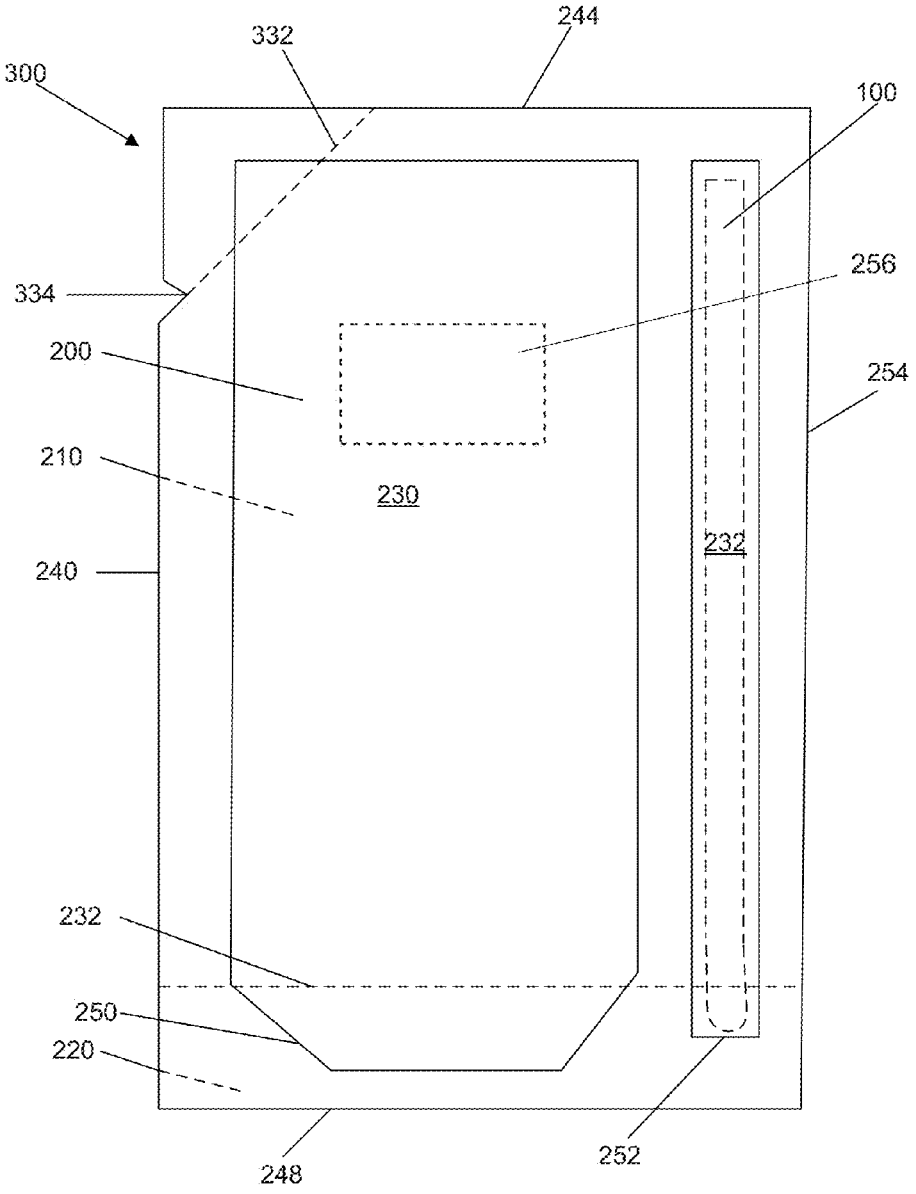
FIG. 8 is a side view of another embodiment of a flexible bag according to the present invention with an alternate dispensing portion.

Front panel 200, back panel 210, and bottom panel 220 are sealed together along selected portions to form first compartment 230 and second compartment 232. Front panel 200, back panel 210, and bottom panel 220 are sealed along a left outer edge 240 of bag 10. Front panel 200 and back panel 210 are sealed along a diagonal top edge 242 and along a horizontal top edge 244. In FIG. 1, horizontal top edge 244 is shown as being not being sealed, which allows insertion of grip 100 within second compartment 232. Front panel 200, back panel 210, and bottom panel 220 are sealed together along a vertical intermediate portion 246 and along a bottom edge 248. The seal along bottom edge 248 between bottom panel 220 and both front panel 200 and back panel 210 preferably does not extend above gusset line 250. The seal along bottom edge 248 between bottom panel 220 and either front panel 200 or back panel 210 preferably does not extend above gusset line 252. Front panel 200, back panel 210, and bottom panel 220 are sealed along a right outer edge 254 of bag 10. The seams may be formed using heat, pressure, adhesive, any other sealing or binding means, or any combination thereof The seams along left outer edge 240, diagonal top edge 242, horizontal top edge 244, intermediate vertical portion 246, and bottom edge 248 form first compartment 230 with front panel 200, back panel 210, and bottom panel 220. When first compartment 230 is filled with the product, bottom panel 220 will expand downward along gusset line 250 within the area enclosed by bottom edge 248, which allows flexible bag 10 to stand on a surface. The volume, shape, and location of first compartment 230 may vary. For example, although the embodiment illustrated in FIGS. 1 and 3 includes a gusset line 250 that is generally U-shaped, gusset line 250 may be any shape including a straight line, a V-shaped line, a trapezoidal line (as shown in FIG. 8), or any other shaped line.

The seams along horizontal top edge 244, intermediate vertical portion 246, bottom edge 248, and right outer edge 254 form second compartment 232 with front panel 200, back panel 210, and bottom panel 220. In this embodiment, second compartment 232 is separate, or discrete, from first compartment 230 such that the contents of one compartment are separated from the contents of the other compartment. Second compartment 232 runs parallel to right outer edge 254 of bag 10. The length of second compartment 232 may be substantially the same as the length of right outer edge 254. The difference between the length of the second compartment and the length of right outer edge 254 is the respective lengths of the seams along horizontal top edge 244 and bottom edge 248 under U-shaped line 252. Second compartment 232 may be offset from right outer edge 254 of bag 10 by the width of the seam along right outer edge 254, approximately 0.5 to 2.5 cm, and preferably about 0.5-1.5 cm. The present invention is not limited to a flexible bag 10 having a second compartment 232 located on the right outer edge 254. For example, second compartment 232 may be located on a top or bottom edge, left edge, or in the middle of flexible bag 10.

Flexible bag 10 may also include a grip 100. The shape of second compartment 232 generally corresponds to the shape of grip 100. In the illustrated embodiment, grip 100 is elongate and straight. Grip 100 has a tapered portion 110 on one end and a body portion 120. Tapered portion 110 makes inserting grip 100 into second compartment 232 easier during the manufacturing process. Tapered portion 110 wedges between front panel 210 and back panel 210 as grip 100 is disposed within second compartment 232. Body portion 120 is the portion of grip 100 that a user will generally grab when handling flexible bag 230. Grip 100 may have a length 130 that is substantially the same as the length of second compartment 232, and grip 100 may have a width 140 that is substantially the same as the width of second compartment 232.

In the illustrated embodiment, grip 100 is disposed entirely within second compartment 232 forming a handle that is offset from right outer edge 254 of bag 10 by the width of the seam along right outer edge 254. Grip 100 is egronomical and easily accessible to a user's hand. A user can quickly and securely grasp grip 100 between the user's thumb and four fingers or between the user's four fingers and palm while handling flexible bag 10 during transport or when dispensing the product from bag 10.

Grip 100 may be either rigid or flexible, but grip 100 should have a stiffness sufficient to resist the bending forces applied to grip 100 by the weight of the product within first compartment 230. Grip 100 should not buckle when a user grasps grip 100 and lifts flexible bag 10 off a surface. Grip 100 also provides structural strength that prevents the panels of bag 10 from collapsing along the length of the bag as the product is dispensed from first compartment 230. For example, grip 100 may be made of high or low density polyethylene.

In an embodiment, grip 100 and flexible bag 10 are configured to prevent flexible bag 100 from collapsing when placed on a surface, for example, a shelf at a retail store. Flexible bag 10 does not collapse because grip 100 maintains its shape in the vertical direction. For example, in the illustrated embodiment, flexible bag 10 remains erect because grip 100 runs along substantially the entire vertical length of flexible bag 10. Keeping flexible bag 10 erect when placed on a surface allows flexible bag 10 to be efficiently stored on the surface and provides a surface on flexible bag 10 to prominently display information 256 regarding the product of flexible bag 10. Such information 256 may include, for example, the brand name, the type or identification of the product contained within flexible bag 10, the directions for using the product, and other types of information regarding the product. In the illustrated embodiment, product information 256 may be displayed on front panel 200 and back panel 210.

Although grip 100 of the illustrated embodiment is depicted as an elongate and straight piece that runs along substantially the entire length of second compartment 232, grip 100 may vary in orientation, length, and shape. For example, grip 100 may be shorter and run along only a portion of second compartment 232 and the outer edge, or grip 100 may be curved. Further, in the illustrated embodiment, grip 100 is tubular with an elliptical cross section. However, grip 100 of the present invention is not limited to the illustrated cross section. For example, grip 100 may be solid, instead of tubular, and may have a different cross-sectional shape such as a circle, square, rectangle, or other shape. Additionally, although grip 100 of the illustrated embodiment is depicted as single piece, grip 100 may comprise more than one piece.

A flexible bag 10 according to the present invention is not limited to a second compartment 232 that is completely enclosed. Second compartment 232 can be any space or void that is at least partially bounded by at least one panel. For example, second compartment 232 may include spatial cavities formed by non-overlapping, alternating sections of front panel 200 and back panel 210. Further, second compartment 232 is not limited to cavities formed by front panel 200, back panel 210, and bottom panel 220. For example, second compartment 232 may be formed by one panel, two panels, or more than three panels.

A flexible bag 10 according to the present invention is not limited to a bag having grip 100 disposed entirely within second compartment 232 as in the illustrated embodiment. Grip 100 may only be partially disposed in second compartment 232, or grip 100 may be disposed on an outer surface of a panel forming first compartment 230 and offset from the edge.

Figure 3:
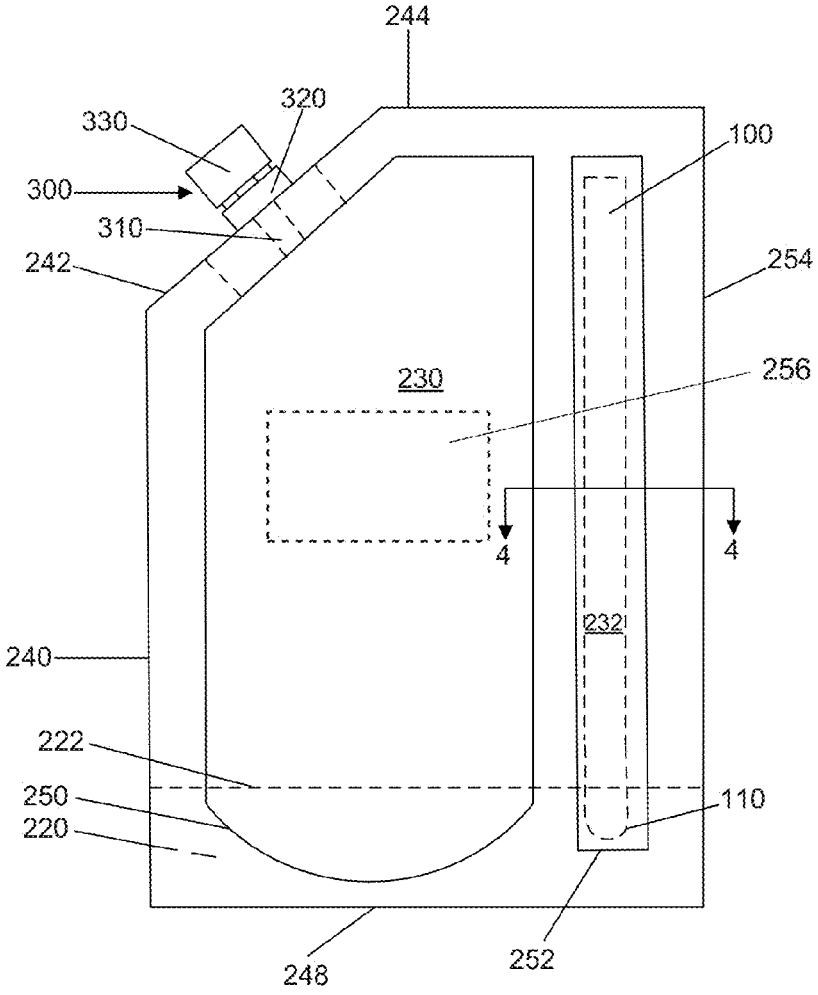
FIG. 3 is a side view of the flexible bag of FIG. 1 with the grip fully inserted.
Figure 5:
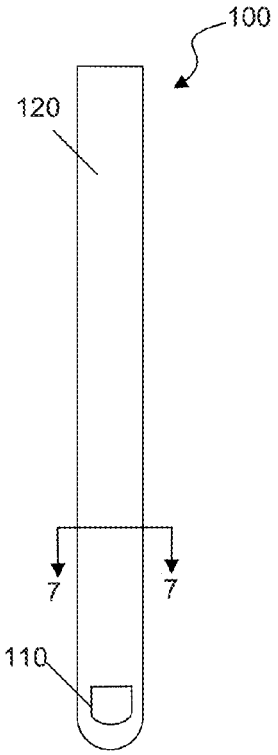
FIG. 5 is a top view of an embodiment of a grip according to an embodiment of the present invention.
Figure 6:
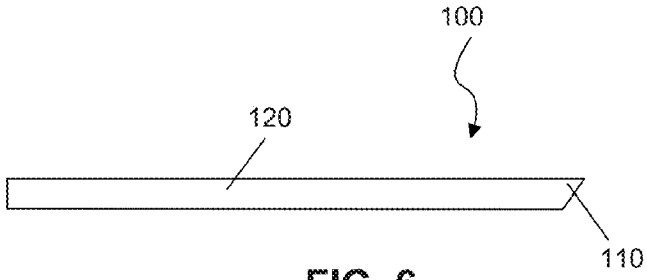
FIG. 6 is a side view of the grip of FIG. 5.
Figure 7:
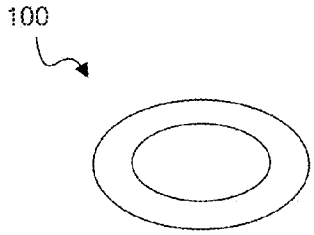
FIG. 7 is a cross-sectional view of the grip of FIGS. 5 and 6 taken through line 7-7.
Figure 4:
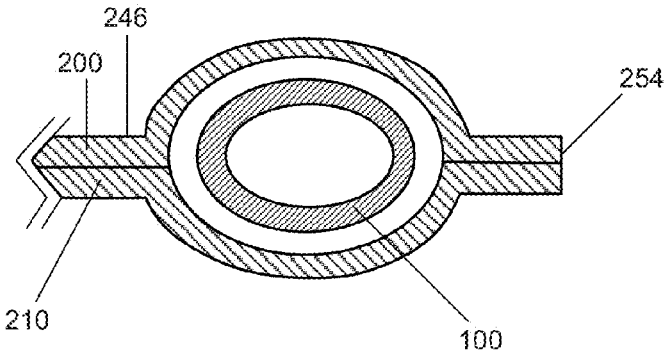
FIG. 4 is a cross-sectional view of the flexible bag of FIGS. 1-3 taken through line 4-4.

Flexible bag 10 may also include a dispensing portion 300. Dispensing portion 300 is an opening, or an area on the at least one panel that can be easily configured to form an opening by cutting, tearing, peeling, or like operation, in the at least one panel or seam forming first compartment 230. Dispensing portion 300 allows the product contained within first compartment 230 to pass to the surrounding atmosphere if dispensed. Dispensing portion 300 may be a separate part. For example, as illustrated in FIGS. 1 and 3, dispensing portion 300 may be a pour spout defining a through bore 310 that is sealed between front panel 200 and back panel 210 along diagonal top edge 242 of bag 10. The pour spout may include an elongated duct 320 that extends from diagonal top edge 242. Duct 320 helps a user pour a liquid product from first compartment 230. To allow the pour spout to be selectively opened and closed, duct 320 may be externally threaded to couple with an internally threaded cap 330.

In another embodiment, dispensing portion 330 may be a metered cap that permits a metered amount of the product contained in flexible bag 10 to be repeatedly dispensed as desired. The metered cap may be any suitable device that is known in the art that dispenses a pre-determined, or metered, amount of the product. A metered cap may include, for example, a reservoir of pre-determined volume near the top of flexible bag 10 that is configured to be filled with the product by inverting flexible bag 10 and configured to subsequently dispense the product contained within the reservoir using a general pouring motion. Accordingly, a user may, for example, quickly and accurately pour a metered dose of the product such as a concentrated soap or detergent into a container and mixing it with a dilutant such as water.

FIG. 8 illustrates an alternative embodiment of dispensing portion 300 that is configured to easily form an opening by tearing or cutting front panel 200 and back panel 210 along a line 332 to form an opening in first compartment 230. Dispensing portion 300 may also include a notch 334 to facilitate the tearing or cutting of the panels.

Figure 9:
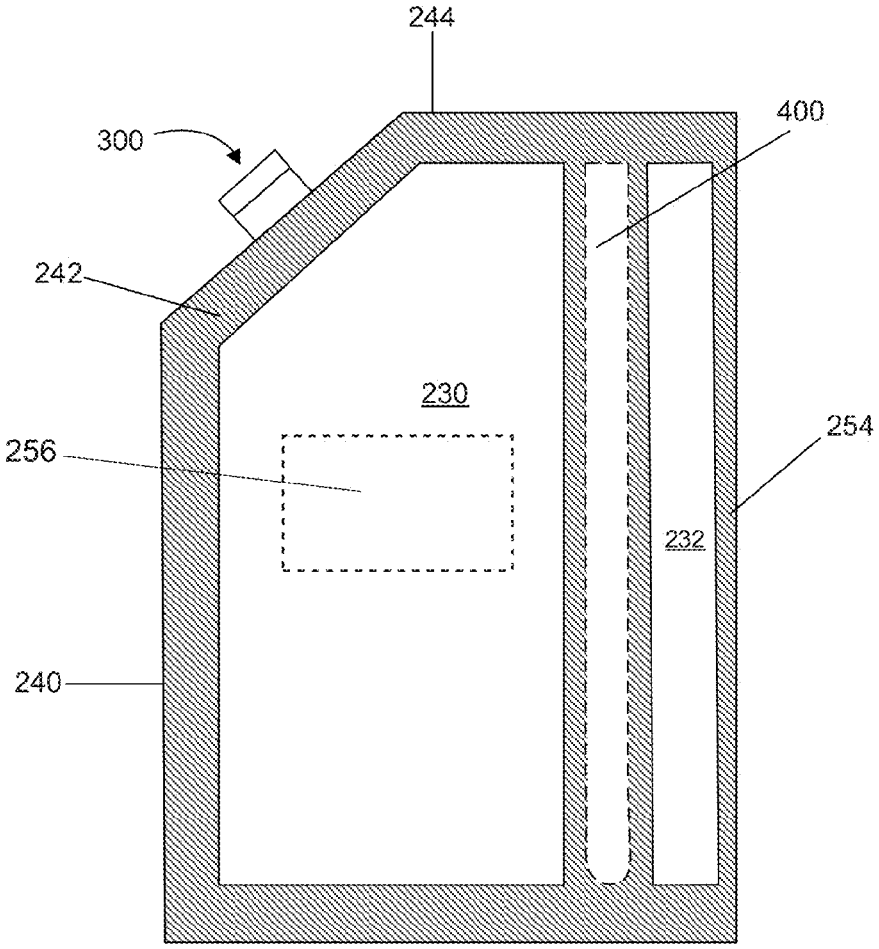
FIG. 9 is a side view of another embodiment of a flexible bag according to the present invention with an optional finger opening.

FIG. 9 illustrates an alternative embodiment of flexible bag 10. In this embodiment, flexible bag 10, as described above, further comprises an optional opening 400 between first compartment 230 and second compartment 232. Opening 400 allows a user's fingers to easily wrap around compartment 230 and grip 100 (not shown) contained therein, providing a more secure grip. Opening 400 may be a slot having an appreciable area of any suitable shape or size, for example, an elongate and substantially rectangular slot as illustrated in FIG. 9, or opening 400 may be a slit comprising a thin through cut or slice. Although in FIG. 9, opening 400 runs along substantially the entire length of second compartment 230, opening 400 may run along only a partial length of second compartment 230. Opening 400 may be formed in the panel portion of flexible bag 10 that is sealed together between first compartment 230 and second compartment 232. For example, opening 400 may be formed in the seam along intermediate vertical portion 246. Opening 400 may be formed by punching, cutting, or other similar operation.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A flexible container comprising:

a first sealed flexible compartment for containing a product;

a second compartment separate from the first compartment;

a separate grip disposed in at least a portion of the second compartment; wherein the grip comprises a tapered portion;

a dispensing portion in communication with the first compartment to allow a product to be dispensed from the first compartment; and a folded bottom gusset panel, wherein the tapered portion of the grip is disposed below the fold of the bottom gusset panel;

wherein the grip is configured such that a user can lift the flexible container containing a product in the first compartment by grabbing the grip and dispense a product from the first compartment without the flexible container collapsing.

2. A flexible container comprising:

a first sealed flexible compartment for containing a product;

a second compartment separate from the first compartment;

an elongate slot between the first compartment and the second compartment;

a separate grip disposed in at least a portion of the second compartment; and a dispensing portion in communication with the first compartment to allow a product to be dispensed from the first compartment;

wherein the grip is configured such that a user can lift the flexible container containing a product in the first compartment by grabbing the grip and dispense a product from the first compartment without the flexible container collapsing.

3. A flexible container comprising:

a first sealed flexible compartment for containing a product;

a second compartment separate from the first compartment;

a folded bottom gusset panel;

a separate grip disposed in at least a portion of the second compartment and comprising a portion disposed below the fold of the bottom gusset panel; and a dispensing portion in communication with the first compartment to allow a product to be dispensed from the first compartment;

wherein the grip is configured such that a user can lift the flexible container containing a product in the first compartment by grabbing the grip and dispense a product from the first compartment without the flexible container collapsing.

4. The flexible container of claim 3, wherein the dispensing portion comprises a pour spout.

5. The flexible container of claim 3, wherein the dispensing portion comprises a metered cap configured to repeatedly dispense a metered amount of the product.

6. The flexible container of claim 3, wherein the grip is disposed entirely within the second compartment.

7. The flexible container of claim 3, wherein the second compartment is near an outer edge of the container.

8. The flexible container of claim 3, wherein the second compartment has a length that is substantially the entire length of the flexible container, and the grip has a length that is substantially equal to a length of the second compartment such that the flexible container remains erect when placed on a horizontal surface.

9. The flexible container of claim 3, wherein the grip is tubular.

10. The flexible container of claim 3, wherein the container is a bag.

11. The flexible container of claim 3, wherein the first compartment is configured to contain a liquid, gel, or solid product.

12. The flexible container of claim 3, wherein the first and second compartments are formed by a plurality of panels.

13. The flexible container of claim 3, wherein the container is formed from one or more panels formed from a laminate of thin sheets or film.

14. The flexible container of claim 3, wherein the first and second compartments are formed by folding a single panel.

15. The flexible container of claim 3, wherein the grip comprises a tapered portion.

16. The flexible container of claim 3, wherein information on a surface of the flexible container is displayed when the flexible container is placed on a horizontal surface.

* * * * *